US006253777B1

(12) United States Patent
Anderson

(10) Patent No.: US 6,253,777 B1
(45) Date of Patent: Jul. 3, 2001

(54) FLAME RESISTANT, LIGHTWEIGHT TENT FOR USE

(75) Inventor: Jerry C. Anderson, Westminister, SC (US)

(73) Assignee: Safety Components Fabric Technologies, Inc., Greenville, SC (US)

( * ) Notice: Subject to any disclaimer, the term of this patent is extended or adjusted under 35 U.S.C. 154(b) by 0 days.

(21) Appl. No.: 09/298,085

(22) Filed: Apr. 22, 1999

(51) Int. Cl.[7] ..... E04H 15/54

(52) U.S. Cl. ..... 135/115; 135/117; 478/251; 478/102

(58) Field of Search ..... 135/139, 156, 135/117, 909, 115; 428/251, 102, 218, 246, 920

(56) References Cited

U.S. PATENT DOCUMENTS 4,500,592 * 2/1985 Lee ..... 428/251
5,842,495 * 12/1998 Egnew ..... 135/133
5,908,043 * 6/1999 Paes ..... 135/139

OTHER PUBLICATIONS

Trevira® FR Technical Bulletin; "Dyeing and Finishing Trevira CS/FR Upholstry Fabrics for Fastness to Mild Solutions of Bleach" Trevira Flame–Resistant Filament brochure.

Modular Command Post System (MCPS) brochure; No. N0024 P18 rev. Jan. 21, 1998.

* cited by examiner

*Primary Examiner*—Beth A. Stephan
(74) *Attorney, Agent, or Firm*—Dority & Manning, P.A.

(57) ABSTRACT

A flame resistant, lightweight tent liner is disclosed. The tent liner is made from flame resistant polyester fibers. In one embodiment, the tent liner is opaque and white in appearance in order to provide maximum lighting inside a tent while at the same time preventing bystanders on the outside of the tent from looking into the tent.

16 Claims, 1 Drawing Sheet

FLAME RESISTANT, LIGHTWEIGHT TENT FOR USE

FIELD OF THE INVENTION

The present invention generally relates to a tent, such as the type used by military personnel as a modular command post. More particularly, the present invention is directed to a tent having a flame resistant inner lining. In particular, a tent liner made according to the present invention has proven to be lightweight, white/opaque, and flame resistant.

BACKGROUND OF THE INVENTION

Military operations generally require a central location from which they can be effectively commanded. For mobile operations, the military defines such a central location as a Modular Command Post. Modular Command Posts generally contain a single tent or a network of tents from which commanders can direct various military operations.

Conventional tents used for Modular Command Posts are generally constructed with a number of discrete sections. Typically, a tent will include a plain wall, a window wall, an entrance way wall, and a roof cap. The sections are generally made from a lightweight, flame resistant fabric. In addition to the primary sections, conventional tents also include a plain wall liner and an entrance way/window wall liner.

The tent liner provides enhanced flame resistant qualities, as well as insulation qualities that allow the liner to be used as an outside wall during warm weather and daylight. Moreover, the tent liner aids in light diffusion to allow increased visibility for persons within the tent, while preventing visibility into the tent by an outside observer.

In the past, tent liners were made from a lightweight, pajama check weave cloth constructed from aramid fibers. One example of a fabric currently used as a tent liner in Modular Command Posts is made from NOMEX fibers marketed by DUPONT.

One difficulty encountered by current manufacturers of military tents is the high cost associated with producing an aramid fiber tent liner that is capable of complying with military specifications, which require that the liner be white/opaque, lightweight, and flame resistant.

As such, a need currently exists for a less expensive and/or improved tent and tent liner fabric. In particular, a need exists for a tent liner fabric that is white/opaque, lightweight, and flame resistant.

SUMMARY OF THE INVENTION

The present invention recognizes and addresses the foregoing disadvantages, and others of prior art constructions and methods.

Accordingly, an object of the present invention is to provide an inexpensive, improved tent suitable for use by military personnel.

It is another object of the present invention to provide an inexpensive tent for military personnel that is lightweight and flame resistant.

Still another object of the present invention is to provide an inexpensive tent liner for use in military tents that is lightweight, white/opaque, and flame resistant.

These and other objects of the present invention are achieved by providing a flame resistant tent liner for constructing a tent suitable for use by military personnel. The tent liner can be attached to an outer wall enclosure, which includes wall sections that comprise the primary structural components of the tent.

In accordance with the present invention, polyester fibers can be used to form the tent liner fabric. The tent liner fabric can have a weight of from about 1.5 ounces per square yard to about 12 ounces per square yard. Further, the polyester fibers can also have a combined denier from about 70 to about 1200 in the warp and fill directions.

In one embodiment of the present invention, the tent liner fabric can be made from AVORA FR polyester fibers marketed by Kosa. A tent liner comprising AVORA FR fibers and produced according to the present invention is generally flame resistant. Under vertical flammability testing, i.e. NFPA 701 and Fed. Test Method Standard No. 191A, Method 5903, a tent liner of the present invention was found to have a char length less than 6.5 inches (average of 5.5 inches for 10 samples) and an after flame time of less than 2.0 seconds.

A tent liner of the present invention can also be opaque and white in color. The opaqueness of the tent liner can prevent observation into the tent or into a segmented section of the tent by persons located outside the tent. Moreover, the white color of the tent liner can aid in light diffusion within the tent, allowing increased visibility by persons located inside the tent.

These and other objects of the present invention are also achieved by providing a flame resistant tent liner that can be attached to an outer wall enclosure. The outer wall enclosure can include a rear wall, side walls, and an entrance way wall. In particular, one embodiment of the present invention includes an outer wall enclosure having a plain (rear) wall, two side walls, and an entrance way wall. The walls can be interconnected by fasteners and supported by a frame assembly. Furthermore, a roof cap supported by cable assemblies can be used to cover the outer wall enclosure. The covered outer wall enclosure can be lined by a flame resistant tent liner of the present invention. Similar to the wall sections, the tent liner can be attached to the interconnected walls by fasteners.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
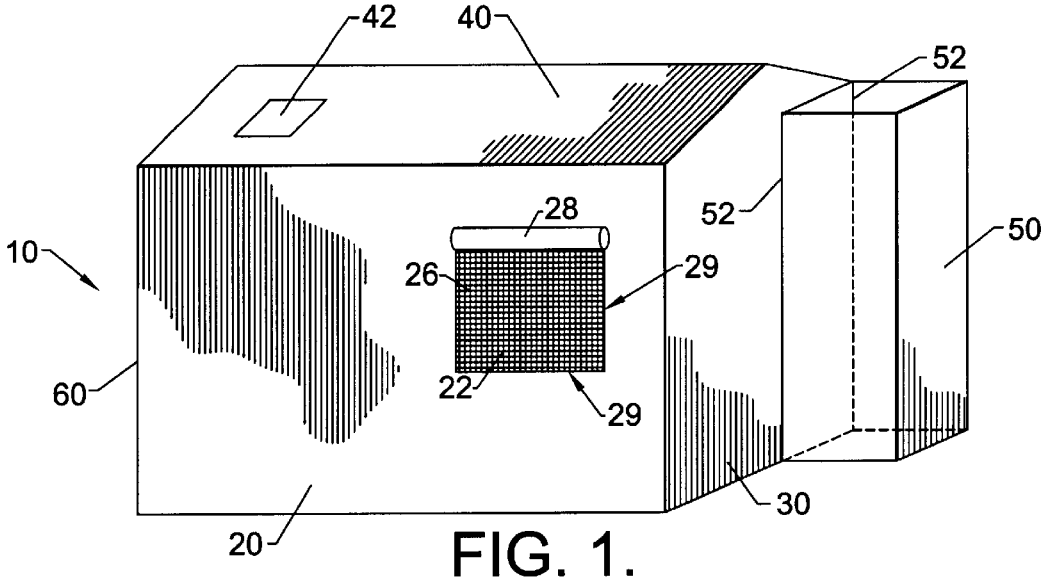
FIG. 1 is a perspective view of one embodiment of a tent made according to the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to an improved tent for military personnel that is more cost-effective than prior tents. In particular, the present invention is directed to a tent having a rear wall, two side walls, an entrance way wall, a roof, and a liner. In one embodiment, a tent of the present invention includes a plain wall (rear), two window walls (side), an entrance way wall, a roof, and a tent liner. In comparison to prior art constructions, a tent of the present invention includes a white/opaque, flame resistant, and lightweight tent liner that is significantly less expensive than conventionally produced tent liners. In particular, it has been discovered that by using AVORA FR fibers in accordance with the present invention, the cost of a tent liner made according to the present invention is approximately one third the cost of tent liners used in prior constructions.

Referring to FIG. 1, one embodiment of an improved tent generally 10 constructed in accordance with the present invention is illustrated. It should be understood, however, that other embodiments are also anticipated and are intended to be covered by this invention.

As shown in FIG. 1, tent 10 includes window wall 20, entrance wall 30, roof cap 40, and plain wall 60. In the embodiment shown as FIG. 1, only one window wall 20 is shown. However, it should be understood that a second window wall exists opposite window wall 20 that is essentially identical to window wall 20, and is thus not shown in FIG. 1, nor specifically described herein.

In one embodiment of the present invention, plain wall 60, window wall 20, entrance wall 30, and roof cap 40 can be constructed of mildew and flame resistant polyester duck cloth. The dimensions of the tent can vary significantly based upon the particular application. In one embodiment, plain wall 60, window wall 20, and entrance wall 30 are approximately 12'6" wide×8' high. In the illustrated embodiment, plain wall 60 is located adjacent to window wall 20 and opposite of entrance wall 30. However, due to the inherently similar size and shape of each wall section, it should be further understood that other embodiments of tent 10 can be easily constructed by simply manipulating the positioning of the wall sections.

Generally, any means suitable for connecting two or more sections of fabric or cloth can be used to connect the wall sections of the tent. In one embodiment, quick release fasteners can be provided for securing the wall sections of the tent together.

As shown in FIG. 1, window wall 20 contains a window 22 that, in one embodiment, can include a nylon webbing screen 26 and a window flap 28. In one embodiment of the present invention, window 22 can be sewn into the bottom seam of a window opening 29 in wall 20, and further attached along window opening 29 by quick release fasteners. Moreover, a window flap 28 can be sewn to the top seam window opening 29. In addition to window 22, the tent can also include a fireproof port 22 located on roof cap 40 for use with internally-fired stoves.

In the embodiment of the present invention depicted in FIG. 1, entrance way wall 30 includes an entrance way door 50 to cover entrance way opening 52. Entrance way door 50 is generally constructed from the same material as the wall sections of tent 10 and is attached to entrance way wall 30 and entrance way opening 52 by quick release fasteners similar to the manner in which the wall sections are attached as described above.

The wall sections can generally be supported by a basic frame assembly, which in one embodiment, is constructed from aluminum alloy tubing that is assembled with a series of fittings and joints. Two end frame assemblies connect to a center frame assembly with eave and ridge purlins that snap together. Moreover, cable assemblies can allow the frame to support roof loads by connecting the sides of tent 10 together. The assembly is designed such that one side can be raised at a time, thus allowing tent 10 to be located on a sloping terrain.

Figure 2:
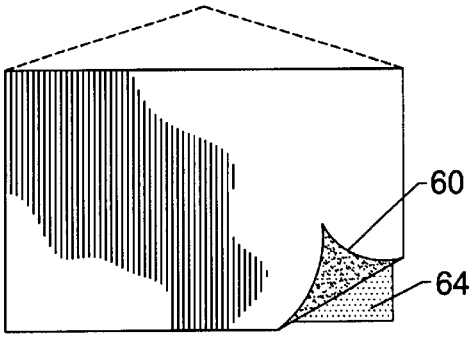
FIG. 2 is a cross-sectional view of the plain wall of the embodiment illustrated in FIG. 1.
Figure 3:
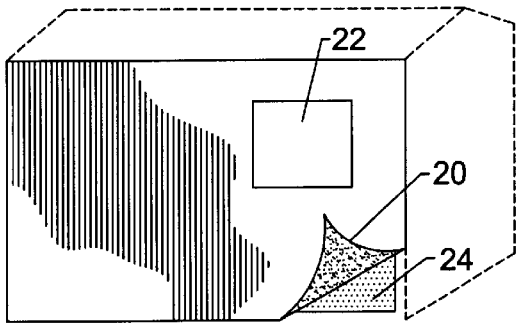
FIG. 3 is a cross-sectional view of a window wall of the embodiment illustrated in FIG. 1.
Figure 4:
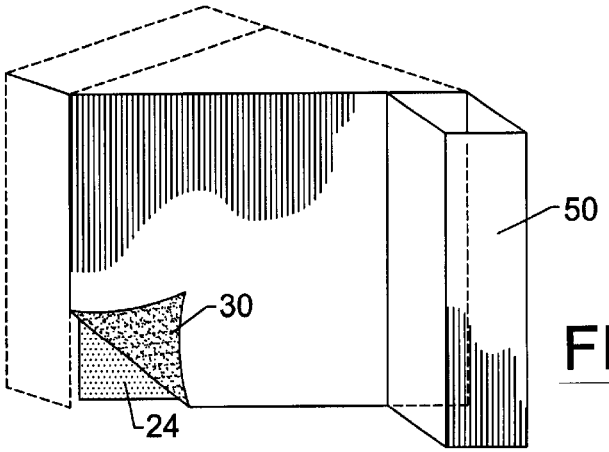
FIG. 4 is a cross-sectional view of the entrance way wall of the embodiment illustrated in FIG. 1.

As shown in FIGS. 2–4, tent 10 is also equipped with a liner material located along the plain wall, window walls, and entrance way wall. In general, liners 64 and 24 can be made from the same fabric. In accordance with the present invention, the fabric that comprises the tent liners can be formed from polyester fibers that are white/opaque and flame resistant. More particularly, a preferred embodiment of the present invention contains tent liners 64 and 24 which are formed from a polyester filament produced by Kosa known as AVORA FR Type 692 FR Fiber. AVORA FR fibers are made from a flame resistant polyester that contains an organic phosphorus compound in the polyethylene terephthalate chain.

To produce a tent liner in accordance with the present invention, first, the yarn is generally unified. In particular, two strands of yarn made from continuous filaments are unified by false twist texturizing. Generally, each strand can have a denier between about 70 and about 1200. For instance, in one embodiment of the present invention, each yarn made from AVORA FR fibers has a denier of about 150, resulting in a combined yarn having a denier of about 300.

False twist texturizing first requires twisting the feeder yarn in the clockwise direction and subsequently twisting the feeder yarn in the counterclockwise direction. Furthermore, heat is applied to the feeder yarn during each twisting step to provide the yarn with memory, to heat-set the yarn, to draw the yarn, and to properly orient the molecular structure of the yarn. Generally, the amount of heat applied to the feeder yarn depends on the type of fiber used. Normally, it is preferred that the temperature of the yarn not exceed its melting point. In one embodiment of the present invention, the feeder yarn made from AVORA FR fibers can be heated to a temperature less than about 482° F., the melting point of the fibers.

Once the yarn is formed, the yarn is then woven or knitted into a fabric for use in accordance with the present invention. In general, the fabric formed from the yarn can have any suitable type of woven or knitted structure. Further, the fabric can be made with various weights in order to optimize the properties of the fabric for any particular application.

After forming the fabric, the fabric can then be scoured, although scouring may not be necessary for all applications. Scouring can partially stabilize the fabric by preventing residual shrinkage, as well as clean the fabric by removing water soluble lubricants used in yarn processing and fabric manufacturing that could cause inadequate flame resistance.

After scouring, the fabric can also be placed on a tenter frame to be dried and heat-set. Generally, heat-setting determines the finished width of the fabric by providing dimensional stability. Specifically, a fabric produced according to the present invention can be heat-set at a temperature between about 350° F. and about 375° F. for approximately one minute.

In general, the tent liner can have a weight between about 1.5 to about 12 ounces per square yard (oz/yd$^2$), and preferably between 3.0 to 4.0 oz/yd$^2$. In one embodiment of the present invention, the fabric can have a weight of 3.6 oz/yd$^2$. In addition, one preferred fabric of the present invention is produced from a 300 denier yarn with a plain weave, approximately 50 ends/inch×34 picks/inch(length x width), to provide the optimal amount of smoothness.

A tent liner produced in accordance with the present invention can have a natural white/opaque color, which may aid in the diffusion of light within tent 10. By aiding in light diffusion, a white-colored tent liner can enable persons within the tent to have increased visibility. Moreover, a white-colored liner that is also opaque can restrict the ability of persons located outside the tent to see inside tent 10.

Further, a tent liner produced according to the present invention is also flame resistant. As required by military specifications, a flame resistant tent liner, such as one made according to the present invention, must satisfy certain flammability tests. One such type of flammability test is known as a Vertical Flammability Test. Among other parameters, Vertical Flammability Tests measure after-flame time and char length to determine the amount of flame resistance possessed by a given fabric. In general, the after-flame time is defined as the time the specimen continues to flame after the burner flame is shut off. Moreover, the char length is generally defined as the distance from the end of the specimen, which was exposed to the flame, to the end of a tear (made lengthwise) of the specimen through the center of the charred area.

A tent liner made according to the present invention has been found to be flame resistant in accordance with two Vertical Flammability Tests, the National Fire Protection Association Small Scale Flame Resistant Criteria (NFPA 701) and Fed. Test Method 5903. After performing the above tests on a tent liner material of the present invention, it was determined that the after-flame time was a maximum of 2.0 seconds. It was further determined that the char length was an average of 5.5 inches for 10 samples, none of which exceeded 6.5 inches.

As such, it has been discovered that a tent 10 produced according to the present invention is significantly less expensive than prior constructions. Furthermore, it has been discovered that tent 10 having a tent liner made according to the present invention remains white/opaque in color, lightweight, and also flame resistant.

As illustrated in FIGS. 2–4, a tent liner constructed according to the present invention is generally attached to plain wall 60, window walls 20, and entrance way wall 30.

Specifically, as shown in FIG. 2, tent liner 64 is attached to the inside of plain wall 60. In one embodiment of the present invention, plain wall liner 64 can be approximately 12' wide and 7' high. Eight quick release male fasteners are located on the inside, approximately 18" apart along the top edge. Seven buckle assemblies with quick release female fasteners are located approximately 12" apart and 22" from the edge along each side, with three more located approximately 5' apart and 12" above the bottom edge. In addition, seven side straps with quick release male fasteners are located approximately 12" apart along the outer edge of each side. On the outside, a 2" strip of pile fastener is sewn along the upper seam of the liner. It should be understood that the above description is one method of attaching plain wall liner 64 to plain wall 60 and other means for attachment may be equally suitable.

Further, as shown in FIGS. 3 & 4, entrance way/window wall liner 24 is attached to window wall 20, as well as entrance way wall 30. In a preferred embodiment, entrance way/window wall liner 24 can be constructed similar to plain wall liner 64, except that it contains an approximately 6'½" high and 3' wide door. A quick release male fastener is located on the upper, inside edge of the door and quick disconnect female fastener in corresponding location on liner 24. A strip of 1" pile fastener is located along the left side and along the top of the liner 24 door opening. A strip of 1" hook fastener is sewn to the outer edge and top of the door. In addition, seven quick release female fasteners are located on the outside along the door opening. As such, in the preferred embodiment, liner 24 is attached to the two window walls 20 and the one entrance way wall 30 in an identical manner. However, it should be understood that the above description is only one method of attaching liner 24 to window walls 20 and entrance way wall 30. Therefore, other means for attachment may be equally suitable.

Although the preferred embodiment of the present invention is described as a tent that serves as a Modular Command Post, a tent or tent liner of the present invention can also be utilized in other applications. Moreover, it should be understood that the natural white color of the tent liner of the present invention may be died to provide liners of varying color depending on the application. Generally, most dying methods known to those of ordinary skill in the art can be used to die the fabric.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A tent comprising:

an outer wall enclosure comprising an entrance way wall, a rear wall, and at least one side wall, said at least one side wall positioned adjacent to said entrance way wall and said rear wall;

a roof cap covering said outer wall enclosure; and an inner lining attached to said outer wall enclosure, said inner wall lining comprising a woven fabric made from flame resistant polyester that contains an organic phosphorus compound in the polyethylene terephthalate chain, said inner wall lining having a weight of about 1.5 ounces per square yard to about 12 ounces per square yard.

2. A tent as defined in claim 1, wherein said inner lining has a white color.

3. A tent as defined in claim 1, wherein said outer wall enclosure comprises an entrance way wall, a rear wall, and two side walls, said two side walls located adjacent to said rear wall and said entrance way wall, said rear wall further being located opposite of said entrance way walls, said inner lining being attached to said rear wall, said two side walls, and said entrance way wall.

4. A tent as defined in claim 3, wherein said rear wall, said two side walls, and said entrance way wall are interconnected by fasteners, said inner lining also being attached to said walls by fasteners.

5. A tent as defined in claim 1, wherein said inner lining has a weight of about 3 ounces per square yard to about 4 ounces per square yard.

6. A tent as defined in claim 1, wherein said inner lining has a char length less than about 7 inches, said inner lining having an after-flame time less than about 3 seconds.

7. A tent as defined in claim 1, wherein said inner lining is made from yarns having a denier of from about 70 to about 1,200.

8. A tent as defined in claim 1, wherein said inner lining is made from yarns having a denier of from about 200 to about 400.

9. A tent as defined in claim 1, wherein said inner lining comprises a woven fabric having a plain weave.

10. A tent as defined in claim 1, wherein said inner lining is made from yarns comprised of continuous filaments.

11. A tent as defined in claim 10, wherein said yarns comprise false twist texturized yarns.

12. A tent suitable for use as a modular command post by military personnel comprising:

an outer wall enclosure;

a roof cap covering said outer wall enclosure; and a white inner lining attached to said outer wall enclosure, said inner lining comprising a woven fabric made from flame resistant polyester that contains an organic phosphorus compound in the polyethylene terephthalate chain, said inner lining having a weight of about 3 ounces per square yard to about 4 ounces per square yard, said flame resistant polyester yarns having a denier of less than about 500 in the warp and fill directions.

13. A tent as defined in claim 12, wherein said flame resistant polyester yarns of said inner lining have a denier of about 200 to about 400 in the warp and fill directions.

14. A tent as defined in claim 12, wherein said inner lining has a char length less than about 6.75 inches, said inner lining having an after-flame time of less than about 2.25 seconds.

15. A tent as defined in claim 12, wherein said fabric comprising said inner lining has a plain weave.

16. A tent as defined in claim 12, wherein said polyester yarns comprising said inner lining comprise false twist texturized yarns.

* * * * *